US007200938B2

(12) United States Patent
Lembke

(10) Patent No.: US 7,200,938 B2
(45) Date of Patent: Apr. 10, 2007

(54) MULTIPLE BLADE RAZOR CARTRIDGE

(75) Inventor: Max Arthur Lembke, Middlesex (GB)

(73) Assignee: Eveready Battery Company, Inc., St. Louis, MO (US)

( * ) Notice: Subject to any disclaimer, the term of this patent is extended or adjusted under 35 U.S.C. 154(b) by 323 days.

(21) Appl. No.: 10/779,835

(22) Filed: Feb. 17, 2004

(65) Prior Publication Data

US 2004/0168323 A1 Sep. 2, 2004

Related U.S. Application Data

(60) Provisional application No. 60/448,194, filed on Feb. 19, 2003.

(51) Int. Cl.
*B26B 21/22* (2006.01)

(52) U.S. Cl. ..... 30/50; 30/527

(58) Field of Classification Search ..... 30/50, 30/527

See application file for complete search history.

(56) References Cited

U.S. PATENT DOCUMENTS 4,774,765 A * 10/1988 Ferraro ..... 30/50
5,546,660 A * 8/1996 Burout et al. ..... 30/50
5,953,825 A * 9/1999 Christman et al. ..... 30/527
6,397,473 B1 6/2002 Clark
2003/0061718 A1* 4/2003 Dansreau ..... 30/532
2004/0221455 A1* 11/2004 Coffin ..... 30/50

FOREIGN PATENT DOCUMENTS

EP 0 854 016 A1 7/1998
WO WO 02/32632 A2 4/2002

* cited by examiner

*Primary Examiner*—Kenneth E. Peterson
*Assistant Examiner*—Sean Michalski
(74) *Attorney, Agent, or Firm*—Michaud-Duffy Group LLP

(57) ABSTRACT

A multiple blade razor cartridge is provided having a plurality of support members each having a plurality of blade seats spaced apart from one another and disposed along the support member. Each of the blade seats is separated from the next successive blade seat by a flexible hinge. A retaining member connects the support members such that the support members are spaced apart and approximately parallel to each other so that each of the blade seats is approximately aligned with a corresponding blade seat on the next successive support member, forming rows of approximately aligned blade seats. A razor blade is fixed to each row of blade seats. The hinges and thereby the support members are deformable in response to an externally applied force such that a relative angle between successive razor blades is variable. A razor assembly including a cartridge as described above coupled to a handle is provided.

8 Claims, 7 Drawing Sheets

MULTIPLE BLADE RAZOR CARTRIDGE

CROSS-REFERENCE TO RELATED APPLICATIONS

This application is entitled to the benefit of and incorporates by reference essential subject matter disclosed in Provisional Patent Application No. 60/448,194 filed on Feb. 19, 2003.

FIELD OF THE INVENTION

The present invention relates to shaving devices in general, and in particular, to shaving devices having multiple razor blades.

BACKGROUND OF THE INVENTION

Modern razors usually include one or more blades disposed within a head or razor cartridge that is mounted on a handle. Each of the razor blades has a cutting edge that is contiguous with a shave plane. Some razors, referred to herein as razor assemblies, have a disposable cartridge while others have a handle and razor cartridge that are combined in a unitary razor assembly. Although a variety of configurations exist, razor cartridges typically include a housing made of a rigid plastic and one or more razor blades mounted in the housing. The housing often includes a cap portion and a seat portion, with the razor blades disposed between the cap and the seat portions. The cartridge may include a guard disposed forward of the razor blades, the cap is usually positioned aft of the razor blades.

The terms forward and aft, as used herein, define relative positions between the various components of a razor assembly. A component forward of the razor blades, for example, is positioned so that the surface to be shaved encounters the component before it encounters the razor blades, if the razor assembly is used in its intended cutting direction (e.g., a guard is typically disposed forward of the razor blades). Accordingly, a component aft of the razor blades, is positioned so that the surface to be shaved encounters the component after it encounters the razor blades, when the razor assembly is used in its intended cutting direction. The guard and cap are usually provided to orient the position of a person's skin relative to the razor blades to optimize the performance of the razor blades during a shaving process.

One disadvantage of many current razor assemblies is that the razor blades are mounted in the razor cartridge at a fixed angle with respect to each other, thus it is important to the performance of the razor and the comfort of the user that the razor be maintained at the appropriate angular position with respect to the surface being shaved. Often, in using conventional razors of this type, each of the multiple blades engages the skin at relatively the same cutting angle. Thus, when shaving one's face or other body parts having non-uniform contours, if one of the razor blades engages the surface to be shaved at less than the optimal angular disposition with respect to the contours of skin, then it is likely that all of the razor blades will engage the skin at approximately the same relative angle such that the quality of the overall shave may be less than optimal.

Another disadvantage of many current razor cartridges is that most razor cartridges have a substantial body portion or housing surrounding the razor blades which can cause, or at least make it difficult, to prevent the build up of shaving debris between the razor blades. When shaving long hair with a conventional razor cartridge, this problem of accumulated build-up can be exacerbated.

Based on the foregoing, it is the general object of the present invention to provide a multiple blade razor cartridge that improves over, or overcomes the problems and drawbacks of the prior art.

SUMMARY OF THE INVENTION

According to the present invention, a razor cartridge is provided that includes a plurality of support members each having a plurality of blade seats spaced apart from one another and disposed along the respective support member. Each of the blade seats is separated from the next successive blade seat by a flexible hinge. Each of the support members are spaced apart from and approximately parallel to each other so that each of the blade seats is approximately aligned with a corresponding blade seat defined by the next successive support member. At least one retaining member extends between and couples the support members to one another. This arrangement forms rows of approximately aligned blade seats. A plurality of razor blades are fixed, one each, to the rows of blade seats. The hinges and thereby, the support members, are deformable in response to an externally applied force such that the relative angle between successive razor blades varies.

In accordance with the present invention, a razor assembly, including a razor cartridge as described above, coupled to a handle, is also provided. The razor assembly includes at least two arm members each having a first end pivotally coupled to the handle and a second end pivotally coupled to the razor cartridge. The first ends of the arm members can be movably coupled to the handle about a common axis. The second ends of the arm members are coupled to the razor cartridge such that at least one arm member is coupled forward of the razor blades and at least one arm member is coupled to the razor cartridge aft of the razor blades.

One advantage of the razor cartridge and assembly of the present invention is that the razor cartridge is deformable between each of the successive razor blades such that the relative angles between the successive razor blades are variable. Thus, when used for shaving skin or other surfaces having non-uniform contours, the successive razor blades can engage the skin at various relative angles with respect to the surface being shaved, thereby increasing the possibility that at least one of the multiple razor blades engages the surface being shaved at an optimal angle with respect thereto.

The razor assembly can include spring biased arm members such that the second ends of the arm members are biased toward one another so that a compressive force is applied to the razor cartridge coupled therebetween. In this configuration, the present invention razor cartridge can provide a cutting surface, formed by the plurality of razor blades, having an outwardly facing convex shape, wherein the term "outwardly" refers to a direction towards the surface to be engaged during a shaving process. Thus, the razor cartridge is deformed about the flexible hinges such that the relative angle between the cutting edges of the successive razor blades is non-uniform and the relative distance between the successive razor blades is varied. This arrangement increases the probability that at least one of the multiple razor blades engages the surface being shaved at an optimal cutting angle.

Also, depending on the tension of the spring, and the force used to engage the cutting surface with the surface to be shaved, the outwardly facing convex shaped cutting surface is further deformable upon engagement with the surface being shaved, further increasing the performance and user comfort of the razor assembly.

Alternatively, the spring biased arm members can be arranged to provide an outwardly facing concave shaped cutting surface or a planar cutting surface. A planar cutting surface can be provided by orienting a spring so that the second ends of the arm members are biased away from each other. Accordingly, the concave and planar cutting surfaces provided are also further deformable during a shaving process upon engagement of the cutting surface with the surface being shaved.

The above-described outwardly facing convex and concave shaped cutting surfaces are provided using flexible hinges of uniform flexibility. However, numerous other variations and shapes of cutting surfaces can be provided with the razor cartridge of the present invention by varying the flexibility of the hinges provided between the successive rows of razor blades. These variations of the present invention are not discussed further herein, however, will be obvious to one skilled in the art practicing the invention.

A further advantage of the present invention is that the razor cartridge does not require the housing or frame surrounding the razor blades that is present in most prior art razor cartridges, thus, the present invention razor cartridge tends to accumulate less shavings, shaving cream, hair, etc., at or near the cutting surface of the razor blades. Additionally, any debris that does accumulate at or near the cutting surface is easier to wash out than in prior art devices having a housing or frame surrounding the razor blades. The razor cartridge of the present invention is especially useful in this regard when shaving longer hair, which tends to build up easily in prior art cartridges.

Another advantage of the present invention is that the cost to manufacture the razor cartridge should be considerably less than those of the prior art, as the applicant's design requires less material surrounding the razor blades.

DETAILED DESCRIPTION OF THE PREFERRED EMBODIMENTS

Figure 1:
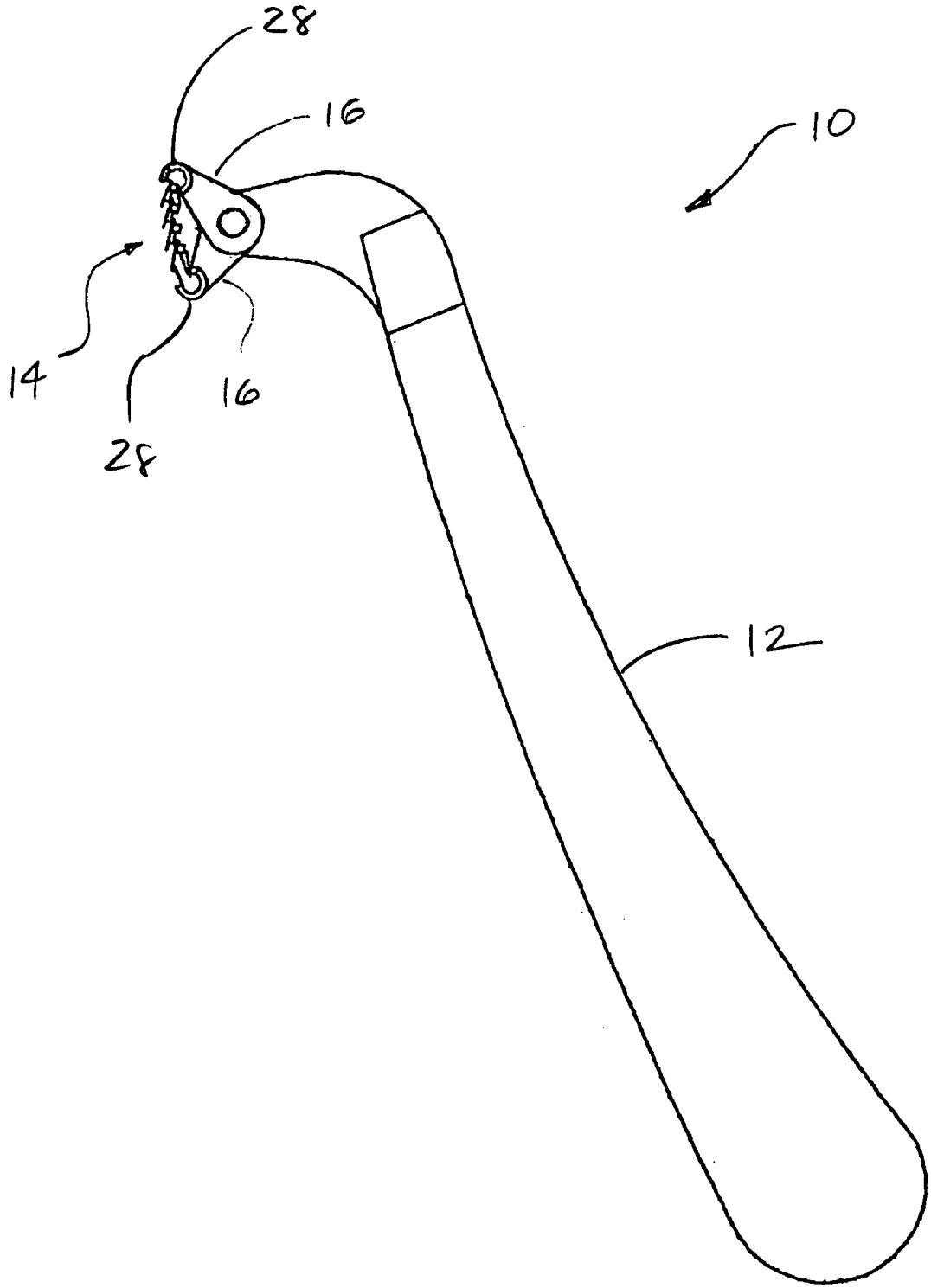
FIG. 1 is a side view of one embodiment of a razor assembly according to the present invention.

Referring to FIG. 1, an embodiment of the present invention razor assembly generally designated by the reference numeral 10 includes a handle 12 and a razor cartridge generally designated by the reference numeral 14, coupled to the handle. Arm members 16 are disposed between the razor cartridge 14 and the handle 12 pivotally coupling the razor cartridge to the handle. The razor cartridge 14 could be permanently coupled to the handle 12 in a unitary design or releasably coupled to the handle as a replaceable razor cartridge.

Figure 2:
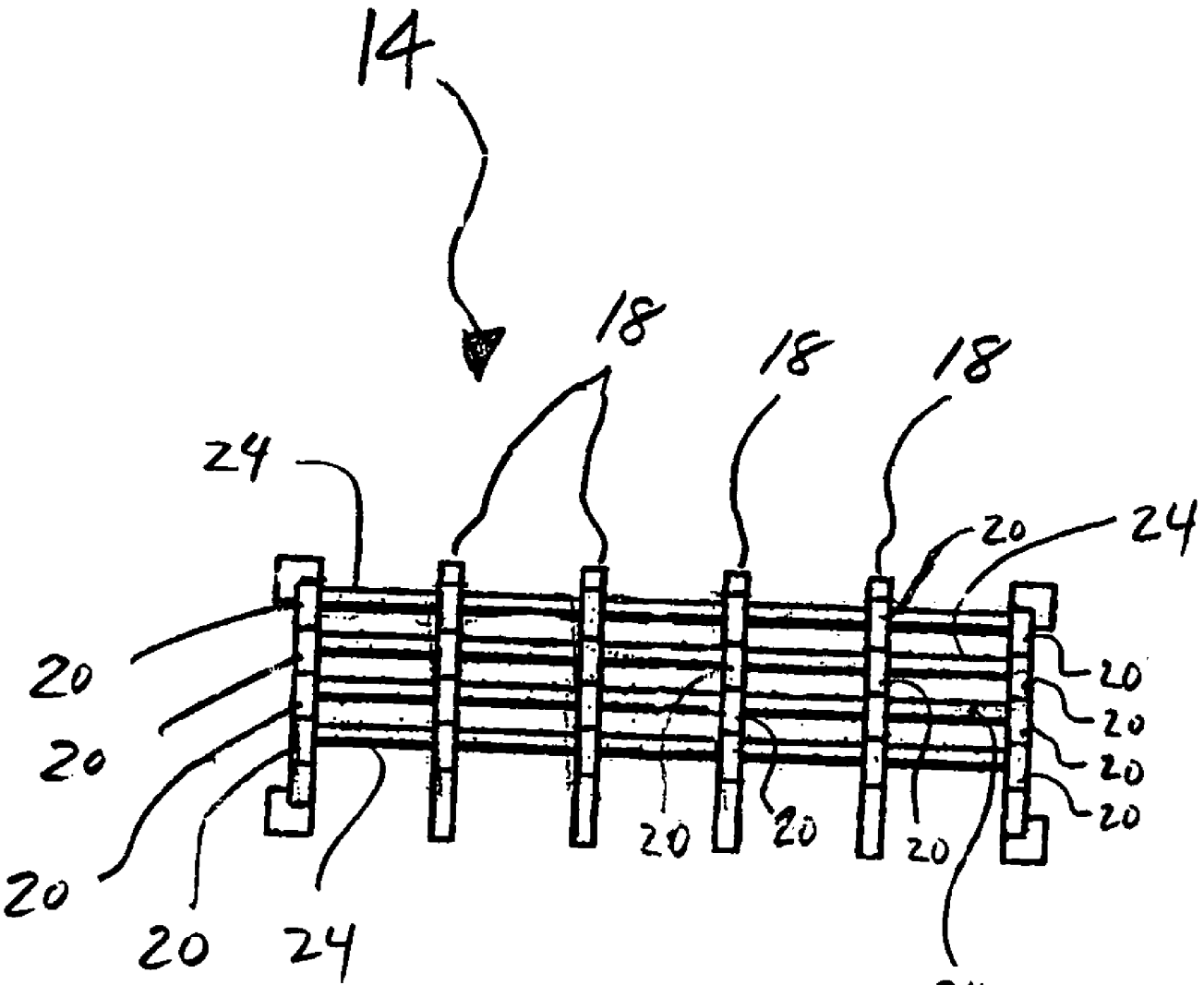
FIG. 2 is a top view of one embodiment of the razor cartridge of the present invention excluding the razor blades.
Figure 3:
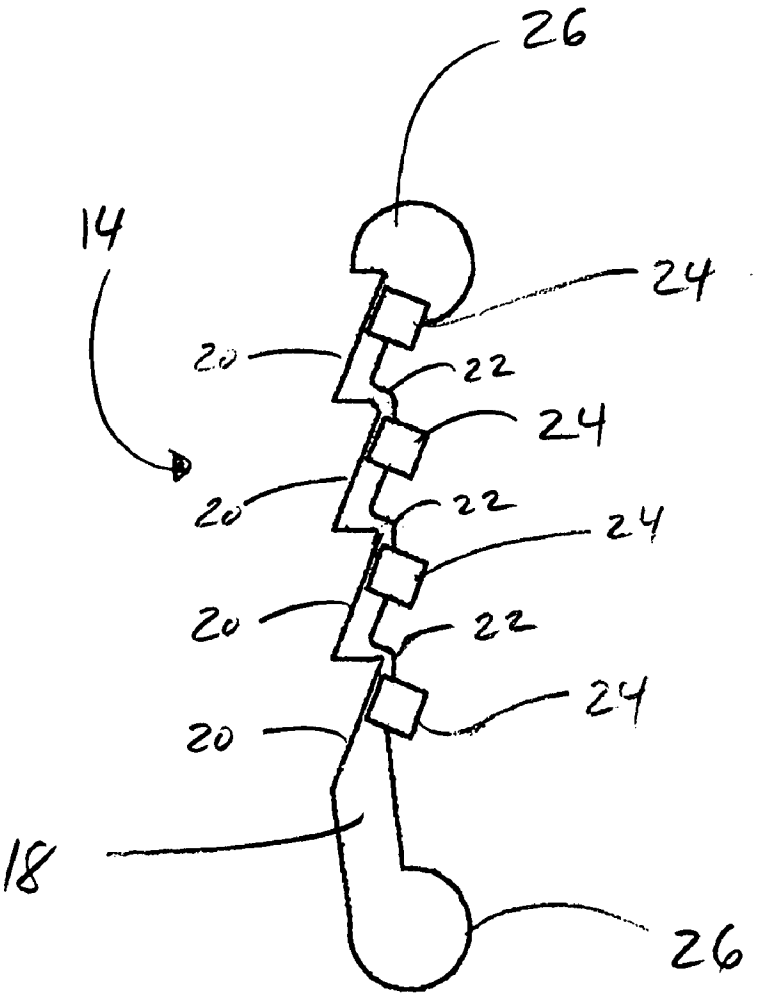
FIG. 3 is a right end view of the razor cartridge shown in FIG. 2.

As shown in FIGS. 2 and 3, the razor cartridge 14 includes a plurality of support members 18 each having a plurality of blade seats 20 spaced apart from one another along the length of the support member. Each of the blade seats 20 is separated from the next successive blade seat by a flexible hinge 22. In the preferred embodiment the support members 18 are manufactured from plastic and the flexible hinge 22 is a plastic hinge, however other types of materials and hinges could be utilized.

The razor cartridge 14 includes a plurality of retaining members 24 attached approximately perpendicular to the support members 18. The support members 18 are spaced apart and arranged so that the blade seats 20 are each approximately aligned with a corresponding blade seat on the next successive support member. Thus, the blade seats 20 form successive rows approximately parallel to each other.

Referring to FIG. 3, the support member 18 has pivot members 26 at each end thereof. The pivot members 26 as shown in FIG. 3 are male pivot heads which cooperate with the female pivot members 28, as shown in FIG. 1, to pivotally couple the razor cartridge 14 to the handle 12 via the arm members 16. In other embodiments of the razor assembly 10, the support members 18 could have female pivot members for coupling with arm members having a corresponding male pivot member. In accordance with the present invention, at least one pivot member 26 is provided forward of the razor blades 30 and at least one pivot member 26 is provided aft of the razor blades for pivotally coupling the razor cartridge 14 to the handle 12.

Figure 5:
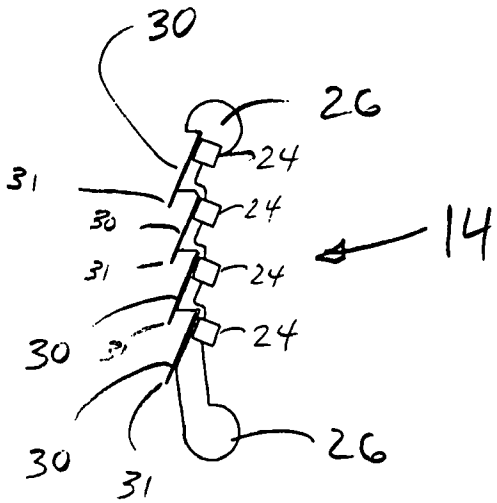
FIG. 5 is a right end view of the FIG. 4 embodiment.
Figure 4:
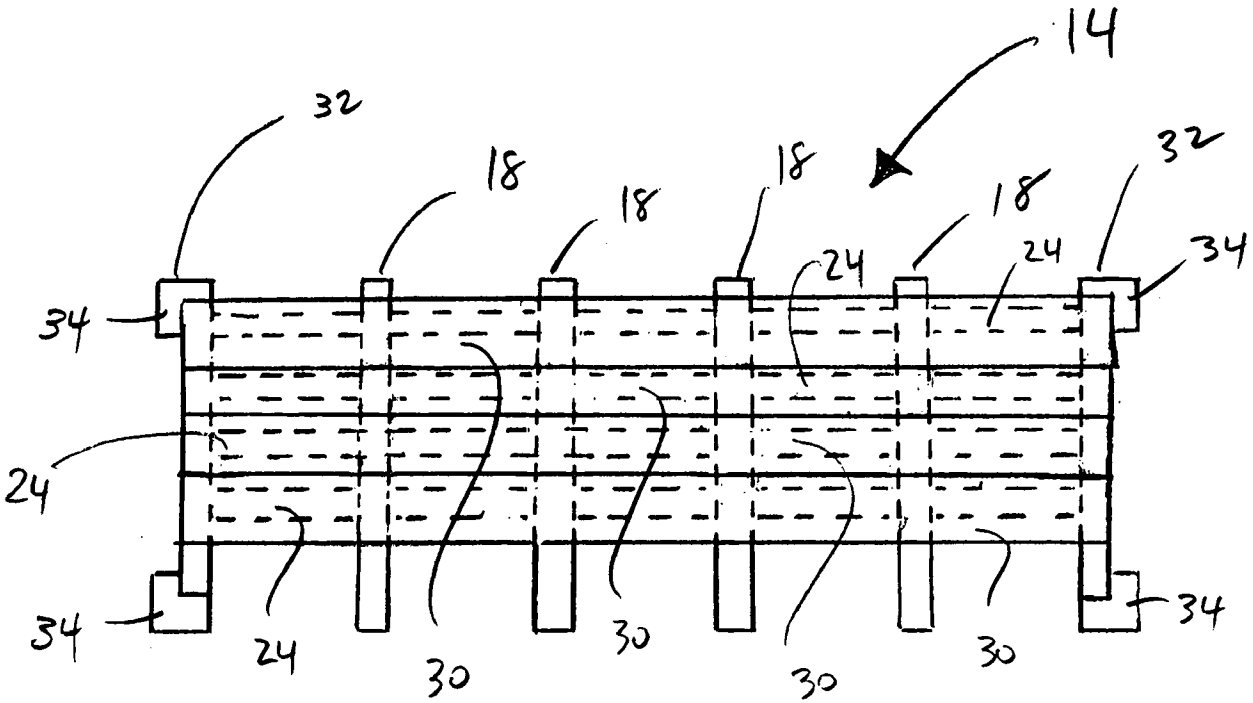
FIG. 4 is a top view of the razor cartridge of FIG. 2 including the razor blades.

Referring to FIGS. 4 and 5, the razor blades 30 are attached to the blade seats 20. In the preferred embodiment, the razor blades 30 are attached to the blade seats 20 using an adhesive. Alternatively, other methods could be utilized to attach the razor blades 30 to the blade seats 20 such as plastic rivets, or other types of fasteners without departing from the scope of the invention.

As shown in FIG. 5, the razor cartridge 14 has a plurality of retaining members 24, each corresponding to one of the plurality of razor blades 30 and attached to the support members 18 so that the retaining members 24 are each approximately aligned with a corresponding razor blade. The blade seats 20 are disposed along the length of the support members 18 on an opposite side of the support member 18 than where the retaining members 24 are attached such that the retaining members do not interfere with the razor blades. The cutting edges 31 of razor blades 30 extend beyond the blade seats 20.

Figure 6:
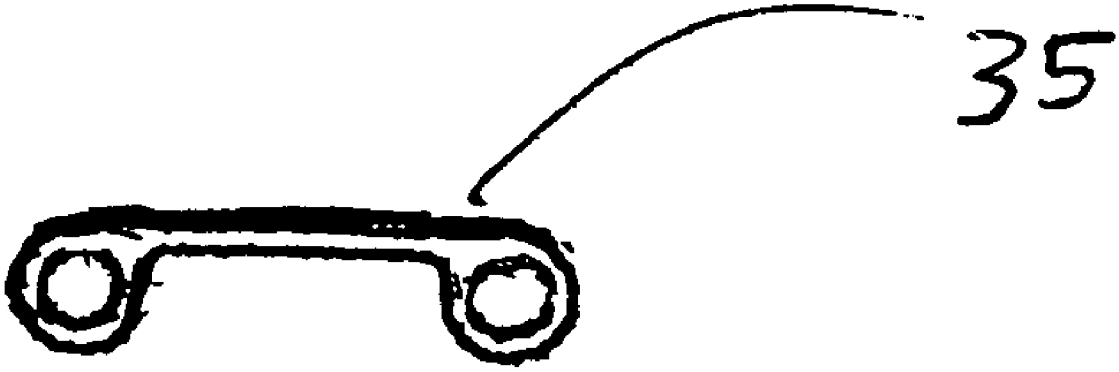
FIG. 6 shows an end guard for use with the present invention.

End support members 32, shown in FIG. 4, are identical to the support members 18 except they include extensions 34 which provide support for end guards 35 shown in FIG. 6. The end support members 32 are attached to the ends of the retaining members 24 at opposing lateral ends of the razor blades 30. The end guards 35 prevent or reduce the risk of inadvertent or unwanted contact of the skin or other surfaces with the lateral ends of the razor blades 30. Alternatively, the end guards 35 could be manufactured integral with the end support members 32. In other embodiments of the razor cartridge 14, the end guards 35 could be eliminated and the end support members 32 replaced with the support members 18.

Figure 7:
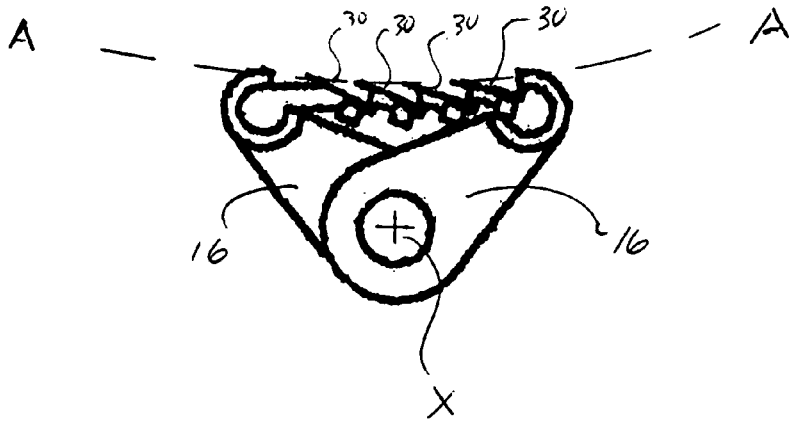
FIG. 7 is an end view of the razor cartridge and arm members of one embodiment of the present invention showing the cutting surface provided by the plurality of razor blades having an outwardly facing concave shape.
Figure 8:
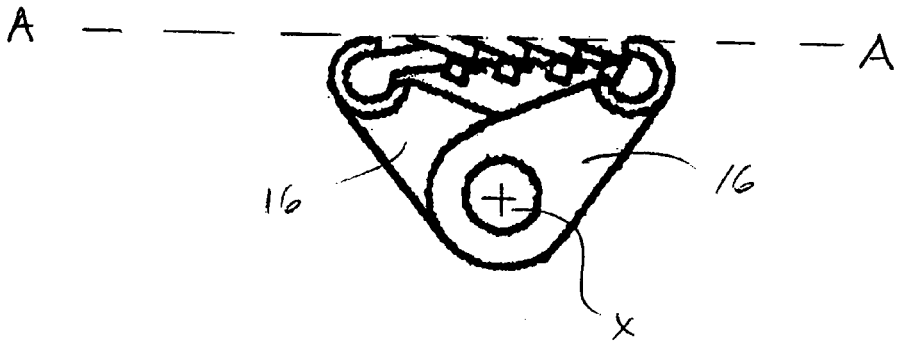
FIG. 8 is an end view of the razor cartridge and arm members of one embodiment of the present invention showing the cutting surface provided by the plurality of razor blades normally planar.
Figure 9:
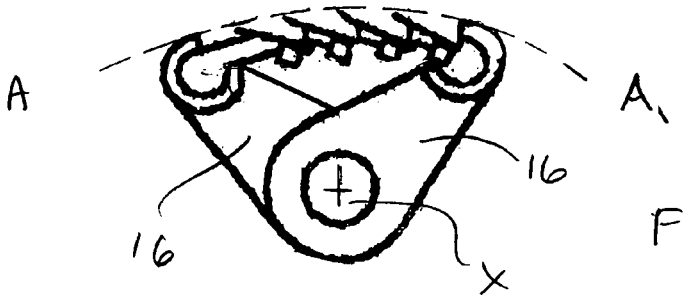
FIG. 9 is an end view of the razor cartridge and arm members of one embodiment of the present invention showing the cutting surface provided by the plurality of razor blades having a normally outwardly facing convex shape.

The structure of the above-described razor cartridge 14 provides a deformable razor cartridge such that the relative cutting angles between the successive razor blades 30 is variable. As shown in FIGS. 7–9, the flexible hinges 22, and thereby, the support members 18 are deformable in response to an externally applied force such that the relative angle between successive razor blades 30 is variable.

FIGS. 7–9 illustrate various configurations of the cutting surface provided by the present invention. FIG. 7 shows the cutting surface provided by the plurality of razor blades 30, illustrated by the line A—A, to have an outwardly facing concave shape. FIG. 8 shows the cutting surface provided by the plurality of razor blades 30 to be planar illustrated by the line A—A, wherein the relative angle between the successive razor blades is approximately uniform. In FIG. 9, the cutting surface is shown to have an outwardly facing convex shape. In each of the configurations shown in FIGS. 7–9, the cutting surface is deformed in response to a force applied by the arm members 16 on the support members 18. The variable cutting angles provided between the successive razor blades provides a closer shave and greater ease and comfort during a shaving process.

As shown in FIGS. 7–10, the arm members 16 are pivotally coupled at a first end to the razor cartridge 14, and at a second end to the handle 12. In the embodiment shown in FIG. 10, the arm members 16 are pivotally coupled to the handle 12 about a common axis X. Alternatively, the arm members 16 could be coupled to the handle 12 about multiple axes or in various other configurations. According to the present invention, at least one arm member 16 is coupled to the razor cartridge 14 forward of the razor blades 30 and at least one arm member 16 is coupled to the razor cartridge 14 aft of the razor blades 30. This arrangement provides means for the above-described deformation of the razor cartridge 14.

Figure 10:
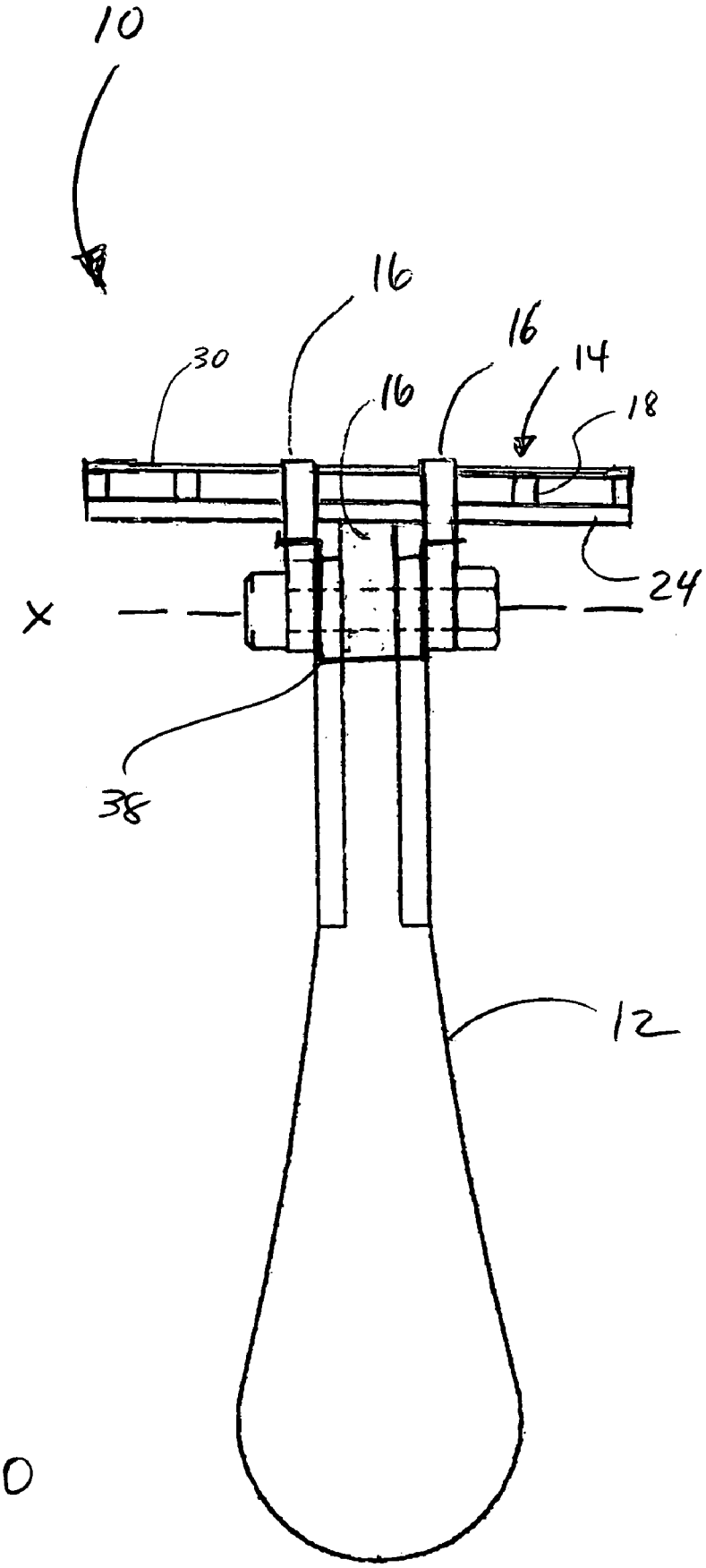
FIG. 10 is elevational view of one embodiment of the razor assembly.

In the embodiment shown in FIG. 10, a spring 38, is provided to bias the second ends of the arm members 16 towards each other. In other embodiments of the razor assembly 10, the spring 38 urges the second ends of the arm members 16 away from each other.

The foregoing description of embodiments of the invention has been presented for the purpose of illustration and description, it is not intended to be exhaustive or to limit the invention to the form disclosed. Obvious modifications and variations are possible in light of the above disclosure. The embodiments described were chosen to best illustrate the principals of the invention and practical applications thereof to enable one of ordinary skill in the art to utilize the invention in various embodiments and with various modifications as suited to the particular use contemplated. It is intended that the scope of the invention be defined by the claims appended hereto.

What is claimed is:

1. A multiple blade razor cartridge comprising:

a plurality of razor blades;

a plurality of support members, each of said support members having a plurality of blade seats spaced apart from one another alone a length of said support member;

wherein each of said blade seats of each of said support members is separated from a next successive blade seat of said support member by a flexible hinge;

a plurality of retaining members connecting said support members such that said support members are spaced apart from each other and arranged so that each of said blade seats is approximately aligned with a corresponding blade seat defined by a next successive support member thereby forming a plurality of rows of approximately aligned blade seats;

each of said plurality of razor blades being fixed to one of said rows of blade seats;

wherein said flexible hinges and thereby said support members are deformable in response to an externally applied force such that a relative angle between successive razor blades is variable; and wherein said rows of blade seats are separated by said flexible hinges of non-uniform flexibility.

2. A razor assembly comprising:

a razor cartridge having a plurality of razor blades;

said razor cartridge having a plurality of support members, each of said support members having a plurality of blade seats spaced apart from one another along a length of said support member;

wherein each of said blade seats of each of said support members is separated from a next successive blade seat of said support member a flexible hinge;

a plurality of retaining members connecting said support members such that said support members are spaced apart from each other and arranged so that each of said blade seats is approximately aligned with a corresponding blade seat defined by a next successive support member thereby forming a plurality of rows of approximately aligned blade seats;

each of said plurality of razor blades being fixed to one of said rows of blade seats; and wherein said hinges and thereby said support members are deformable in response to an externally applied force such that a relative angle between successive razor blades is variable;

at least two arm members each having a first end pivotally coupled to said handle and a second end pivotally coupled to said razor cartridge;

said second ends of said arm members coupled to said razor cartridge such that at least one arm member is coupled to said razor cartridge forward of said razor blades and at least one of said arm members is coupled to said cartridge aft of said razor blades;

wherein said razor cartridge being retained between said second ends of said at least two arm members; and wherein said first ends of said at least two arm members are pivotally coupled to said handle about a common axis.

3. A razor assembly comprising:

a handle;

a razor cartridge having a plurality of razor blades;

said razor cartridge having a plurality of support members, each of said support members having a plurality of blade seats spaced apart from one another alone a length of said support member;

wherein each of said blade seats of each of said support members is separated from a next successive blade seat of said support member by a flexible hinge;

a plurality of retaining members connecting said support members such that said support members are spaced apart from each other and arranged so that each of said blade seats is approximately aligned with a corresponding blade seat defined by a next successive support member thereby forming a plurality of rows of approximately aligned blade seats;

each of said plurality of razor blades being fixed to one of said rows of blade seats; and wherein said hinges and thereby said support members are deformable in response to an externally applied force such that a relative angle between successive razor blades is variable;

at least two arm members each having a first end pivotally coupled to said handle and a second end pivotally coupled to said razor cartridge;

said second ends of said arm members coupled to said razor cartridge such that at least one arm member is coupled to said razor cartridge forward of said razor blades and at least one of said arm members is coupled to said cartridge aft of said razor blades;

wherein said razor cartridge being retained between said second ends of said at least two arm members;

wherein a spring is coupled to said at least two arm members such that said second ends of said arm members are biased toward one another applying a compressive force to said razor cartridge retained therebetween; and wherein said spring deforms said hinges and thereby said support members increasing the relative angle between successive razor blades such that said plurality of razor blades provides an outwardly facing convex shaped cutting surface.

4. A razor assembly as defined in claim 3 wherein said outwardly facing convex shaped cutting surface is further deformable upon engagement with a surface being shaved during a shaving process.

5. A razor assembly as defined in claim 3 wherein said spring deforms said hinges and thereby said support members varying the relative angle between successive razor blades such that said plurality of razor blades provides an outwardly facing concave shaped cutting surface.

6. A razor assembly as defined in claim 5 wherein said outwardly facing concave shaped cutting surface is further deformable upon engagement with a surface being shaved during a shaving process.

7. A razor assembly comprising:

a handle;

a razor cartridge having a plurality of razor blades;

said razor cartridge having a plurality of support members, each of said support members having a plurality of blade seats spaced apart from one another along a length of said support member;

wherein each of said blade seats of each of said support members is separated from a next successive blade seat of said support member by a flexible hinge;

a plurality of retaining members connecting said support members such that said support members are spaced apart from each other and arranged so that each of said blade seats is approximately aligned with a corresponding blade seat defined by a next successive support member thereby forming a plurality of rows of approximately aligned blade seats;

each of said plurality of razor blades being fixed to one of said rows of blade seats; and wherein said hinges and thereby said support members are deformable in response to an externally applied force such that a relative angle between successive razor blades is variable;

at least two arm members each having a first end pivotally coupled to said handle and a second end pivotally coupled to said razor cartridge;

said second ends of said arm members coupled to said razor cartridge such that at least one arm member is coupled to said razor cartridge forward of said razor blades and at least one of said arm members is coupled to said cartridge aft of said razor blades;

wherein said razor cartridge being retained between said second ends of said at least two arm members;

wherein a spring is coupled to said at least two arm members such that said second ends of said arm members are biased toward one another applying a compressive force to said razor cartridge retained therebetween; and a spring coupled to said at least two arm members such that said second ends of said arm members are biased away from one another such that said plurality of razor blades provides a normally planar cutting surface and the relative angle between successive razor blades is uniform.

8. A razor assembly as defined in claim 7 wherein said normally planar cutting surface is further deformable upon engagement with skin during a shaving process.

* * * * *